US010649377B2

(12) United States Patent
Ogura et al.

(10) Patent No.: US 10,649,377 B2
(45) Date of Patent: May 12, 2020

(54) IMAGE FORMING APPARATUS

(71) Applicant: CANON KABUSHIKI KAISHA, Tokyo (JP)

(72) Inventors: Ryota Ogura, Numazu (JP); Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/451,711

(22) Filed: Jun. 25, 2019

(65) Prior Publication Data

US 2019/0317434 A1 Oct. 17, 2019

Related U.S. Application Data

(63) Continuation of application No. PCT/JP2017/046105, filed on Dec. 22, 2017.

(30) Foreign Application Priority Data

Dec. 26, 2016 (JP) ..... 2016-251541

(51) Int. Cl.
*G03G 15/20* (2006.01)
*G03G 15/00* (2006.01)

(52) U.S. Cl.
CPC ..... *G03G 15/205* (2013.01); *G03G 15/2042* (2013.01); *G03G 15/5062* (2013.01)

(58) Field of Classification Search
CPC ..... G03G 15/2039; G03G 15/2042; G03G 15/2046; G03G 15/205
See application file for complete search history.

(56) References Cited

U.S. PATENT DOCUMENTS 4,977,431 A 12/1990 Fuji
7,457,557 B2 11/2008 Roof et al.
(Continued)

FOREIGN PATENT DOCUMENTS

JP H01-237585 A 9/1989
JP H08-138832 A 5/1996
(Continued)

OTHER PUBLICATIONS

International Search Report and Written Opinion dated Jul. 11, 2019, issued in International Application No. PCT/JP2017/046105.
(Continued)

*Primary Examiner* — Erika J Villaluna
(74) *Attorney, Agent, or Firm* — Venable LLP

(57) ABSTRACT

In a heater including a plurality of first temperature detection elements that are arranged at predetermined intervals in a longitudinal direction of a substrate and respectively output temperature signals individually, and a plurality of second temperature detection elements that are arranged at predetermined intervals in positions that differ from the positions of the first temperature detection elements in a lateral direction that is orthogonal to the longitudinal direction but correspond to the positions of at least some of the plurality of first temperature detection elements in the longitudinal direction, and that output a single temperature signal obtained by adding individual temperature signals together, the individual temperature signals included in the single temperature signal are acquired on the basis of the plurality of temperature signals output by the plurality of first temperature detection elements and the single temperature signal.

9 Claims, 9 Drawing Sheets

(56) References Cited

U.S. PATENT DOCUMENTS

| | | | |
|---|---|---|---|
| 2007/0237536 | A1 | 10/2007 | Roof et al. |
| 2017/0102650 | A1 | 4/2017 | Shimura et al. |

FOREIGN PATENT DOCUMENTS

| | | | |
|---|---|---|---|
| JP | H10-301413 | A | 11/1998 |
| JP | H11-65338 | A | 3/1999 |
| JP | 2002-072760 | A | 3/2002 |
| JP | 2013-003382 | A | 1/2013 |
| JP | 2015-194713 | A | 11/2015 |

OTHER PUBLICATIONS

International Search Report dated Mar. 27, 2018, issued in corresponding International Patent Application No. PCT/JP2017/046105.

IMAGE FORMING APPARATUS

CROSS-REFERENCE TO RELATED APPLICATIONS

This application is a Continuation of International Patent Application No. PCT/JP2017/046105, filed Dec. 22, 2017, which claims the benefit of Japanese Patent Application No. 2016-251541, filed Dec. 26, 2016, which is hereby incorporated by reference herein in its entirety.

BACKGROUND OF THE INVENTION

Field of the Invention

The present invention relates to an image forming apparatus including an image heating apparatus.

Background Art

A conventional image heating apparatus, such as a fixing apparatus provided in an image forming apparatus that uses an electrophotographic system, an electrostatic recording system, or the like, is configured to include a tubular film, a flat plate-shaped heater that is in contact with an inner surface of the film, and a roller that forms a nip portion together with the heater via the film. The flat plate-shaped heater may be divided into heat generating areas in a longitudinal direction of the heater, and the respective heat generating areas may be configured so that the temperatures thereof can be regulated independently. In this type of image heating apparatus, a configuration in which a thermistor is formed in each heat generating area as a temperature detection element in order to detect the temperature in each heat generating area has been proposed (PTL 1). Further, in a configuration in which a plurality of thermistors are formed to detect the temperature of the heater, a configuration in which some of the plurality of thermistors are connected in parallel in order to reduce the number of signal lines has been proposed (PTL 2).

CITATION LIST

Patent Literature

PTL 1 Japanese Patent Application Publication No. 2015-194713

PTL 2 Japanese Patent Application Publication No. 2013-003382

SUMMARY OF THE INVENTION

However, when a thermistor is formed in each heat generating area, as in PTL 1, the number of wires connected to the thermistors increases as the number of heat generating areas increases, making it difficult to reduce the size of the heater. Further, the plurality of thermistors connected in parallel, as in PTL 2, output a single temperature signal obtained by adding individual temperature signals together, and therefore the temperatures of the individual thermistors included in the parallel connection cannot be detected individually.

An object of the present invention is to provide a technique with which individual detected temperatures from a plurality of temperature detection elements connected in parallel can be obtained, leading to an improvement in apparatus safety.

To achieve the object described above, an image forming apparatus according to the present invention includes:

a fixing portion that includes a heater having a substrate, a heating element provided on the substrate, and a plurality of temperature detection elements provided on the substrate, and that heats an image formed on a recording material so as to fix the image on the recording material using heat from the heater; and a power control portion that controls power to be supplied to the heating element on the basis of temperature signals output by the temperature detection elements, wherein the plurality of temperature detection elements include:

a plurality of first temperature detection elements that are arranged at predetermined intervals in a longitudinal direction of the substrate and respectively output temperature signals individually; and a plurality of second temperature detection elements that are arranged at predetermined intervals in positions that differ from the positions of the first temperature detection elements in a lateral direction that is orthogonal to the longitudinal direction but correspond to the positions of at least some of the plurality of first temperature detection elements in the longitudinal direction, and that output a single temperature signal obtained by adding individual temperature signals together, and the apparatus further includes a temperature acquisition portion that acquires the individual temperature signals included in the single temperature signal on the basis of the plurality of temperature signals output by the plurality of first temperature detection elements and the single temperature signal.

According to the present invention, individual detected temperatures from a plurality of temperature detection elements connected in parallel can be obtained, leading to an improvement in apparatus safety.

DESCRIPTION OF THE EMBODIMENTS

Exemplary modes for carrying out the invention will be described in detail below on the basis of embodiments, with reference to the figures. Note that dimensions, materials, shapes, relative arrangements, and so on of constituent components described in the embodiments are to be modified as appropriate in accordance with the configuration of the apparatus to which the invention is applied and various conditions. In other words, the scope of the invention is not limited to the following embodiments.

First Embodiment

Figure 1:
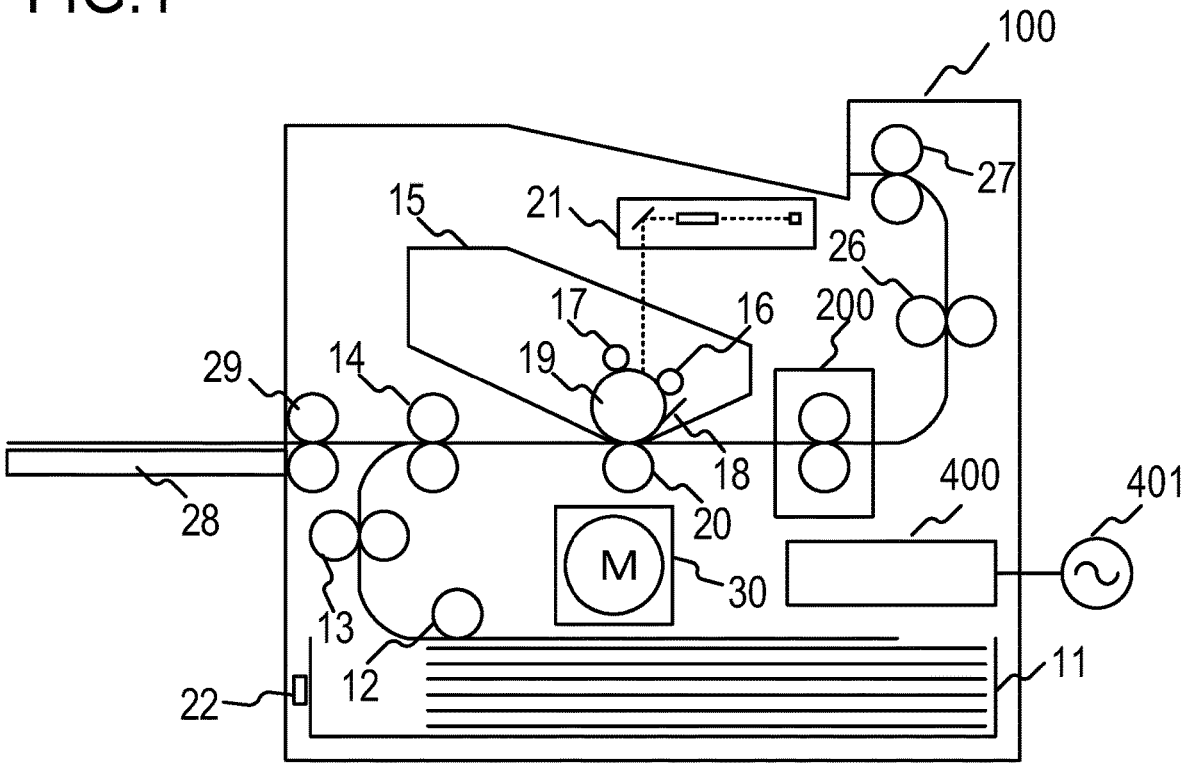
FIG. 1 is a sectional view of an image forming apparatus according to a first embodiment.

FIG. 1 is a schematic sectional view of an electrophotographic-system image forming apparatus (a laser printer 100) according to an embodiment of the present invention. A copier, a printer, or the like using an electrophotographic system or an electrostatic recording system may be cited as image forming apparatuses to which the present invention can be applied, but here, a case in which the present invention is applied to a laser printer will be described. Further, a fixing unit that fixes an unfixed toner image (a developer image) onto a recording material after the toner image has been transferred onto the recording material, a gloss applying apparatus that improves the gloss value of the toner image by reheating the toner image after the toner image has been fixed onto the recording material, and so on may be cited as image heating apparatuses installed in the image forming apparatus.

When a print signal is generated, a laser beam modulated in accordance with image information is emitted by a scanning unit 21 and used to scan a photosensitive member 19 charged to a predetermined polarity by a charging roller 16. As a result, an electrostatic latent image is formed on the photosensitive member 19. Toner is supplied to the electrostatic latent image from a developing roller 17, whereby a toner image corresponding to the image information is formed on the photosensitive member 19. Meanwhile, recording paper P stacked on a paper feeding cassette 11 as a recording material is fed one sheet at a time by a pickup roller 12 and transported by a pair of transporting rollers 13 toward a pair of resist rollers 14. Further, in alignment with a timing at which the toner image on the photosensitive member 19 reaches a transfer position formed by the photosensitive member 19 and a transfer roller 20, the recording paper P is transported to the transfer position from the resist rollers 14. As the recording paper P passes over the transfer position, the toner image on the photosensitive member 19 is transferred onto the recording paper P. The recording paper P is then heated by a fixing apparatus 200 (a fixing portion) serving as an image heating apparatus, whereby the toner image is heated so as to be fixed onto the recording paper P. The recording paper P carrying the fixed toner image is then discharged onto a tray on an upper portion of the laser printer 100 by a pair of transporting rollers 26, 27.

Note that toner and the like remaining on the surface of the photosensitive member 19 is removed by a cleaner 18, whereby the photosensitive member 19 is cleaned. A paper feeding tray (a manual feed tray) 28 includes a pair of recording paper restricting plates that can be adjusted in width in accordance with the size of the recording paper P, and is provided in order to handle recording paper P of a size other than a standard size. A pickup roller 29 is a roller for feeding the recording paper P from the paper feeding tray 28. A motor 30 is a motor for driving the fixing apparatus 200 and so on. Power is supplied to the fixing apparatus 200 from a control circuit 400 connected to a commercial AC power supply 401 as an electrification control portion or a power control portion. The photosensitive member 19, the charging roller 16, the scanning unit 21, the developing device 17, and the transfer roller 20, described above, together constitute an image forming portion for forming an unfixed image on the recording paper P. Further, in this embodiment, a cleaning unit including the photosensitive member 19 and the cleaner 18 and a developing unit including the charging roller 16 and the developing roller 17 are configured to be attachable to an apparatus main body of the laser printer 100 as a process cartridge 15.

Figure 2:
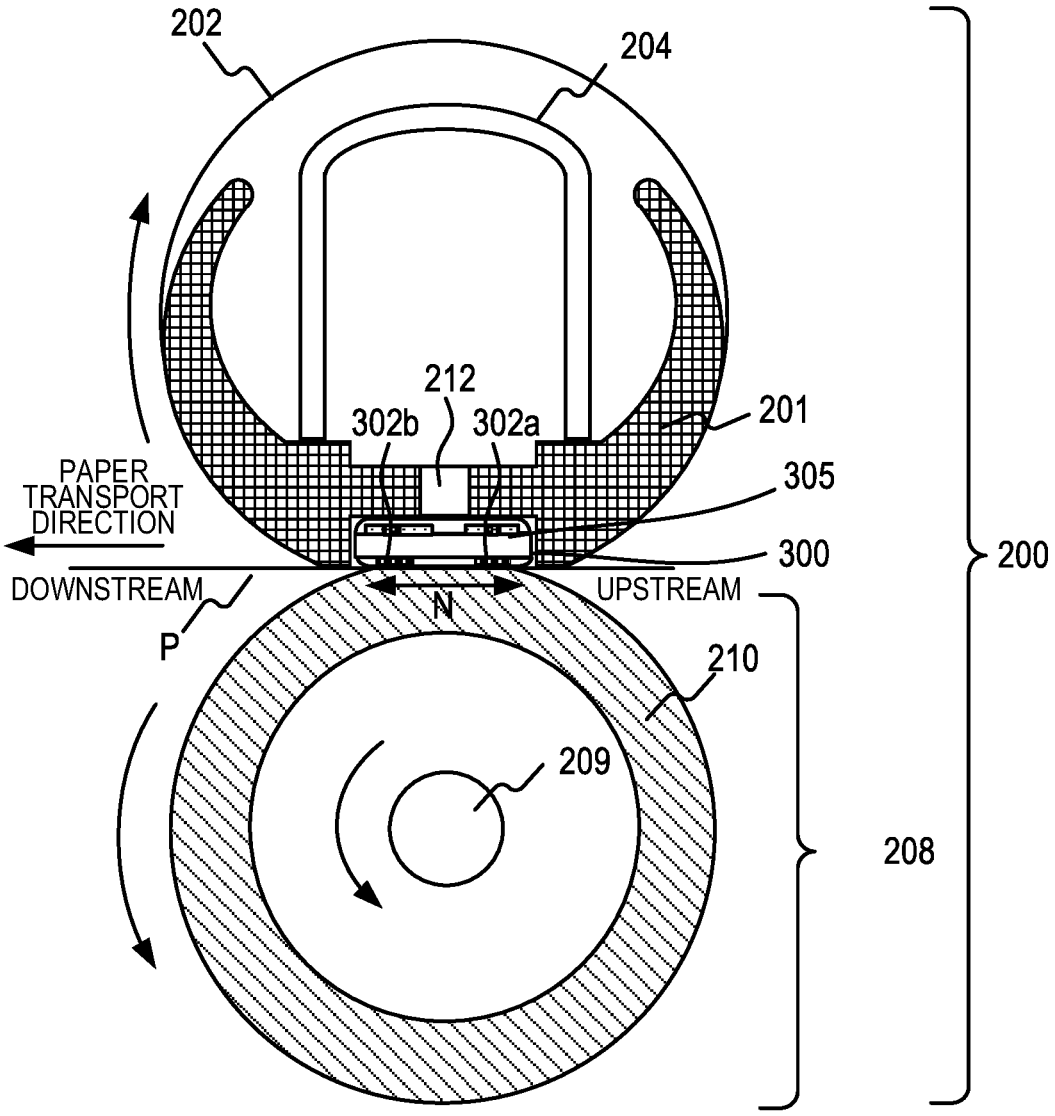
FIG. 2 is a sectional view of an image heating apparatus according to the first embodiment.

FIG. 2 is a sectional pattern diagram showing the fixing apparatus 200 according to this embodiment. The fixing apparatus 200 includes a tubular film (an endless film) 202, a heater 300 that is in contact with an inner surface of the film 202, and a pressure roller (a nip portion forming member) 208 that forms a fixing nip portion N together with the heater 300 via the film 202. The material of a base layer of the film 202 is a heat-resistant resin such as polyimide or a metal such as stainless steel. An elastic layer made of heat-resistant rubber or the like may be provided on the surface of the film 202. The pressure roller 208 includes a core 209 formed from a material such as iron or aluminum, and an elastic layer 210 formed from a material such as silicone rubber. The heater 300 is held by a holding member 201 made of heat-resistant resin. The holding member 201 also has a guide function for guiding rotation of the film 202. A metal stay 204 is used to exert the pressure (the biasing force) of a spring, not shown in the figure, on the holding member 201. The pressure roller 208 rotates in the direction of an arrow upon reception of motive force from a motor, not shown in the figure. When the pressure roller 208 rotates, the film 202 rotates so as to follow the pressure roller 208. The recording paper P carrying an unfixed toner image is subjected to fixing processing by being heated while being transported through the fixing nip portion N in a nipped state.

The heater 300 generates the heat that is used to heat the recording paper P when heating resistors 302*a*, 302*b* provided on a ceramic substrate 305, to be described below, are electrified so as to generate heat. A safety protection element 212 abuts the heater 300. The safety protection element 212 is a thermo switch, a temperature fuse, or the like, for example, which is activated when the heater 300 generates heat abnormally so as to cut off the power supplied to the heater 300.

Figure 3A:
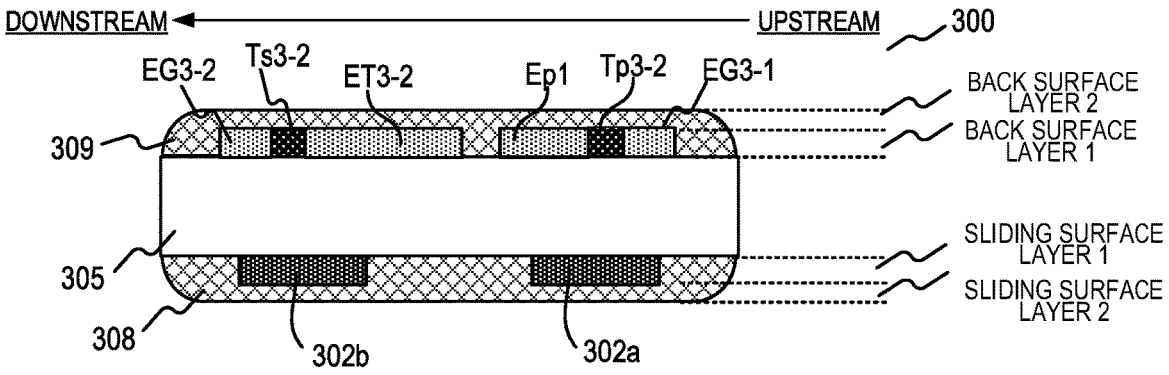
FIGS. 3A and 3B are views showing a heater configuration according to the first embodiment.
Figure 3B:
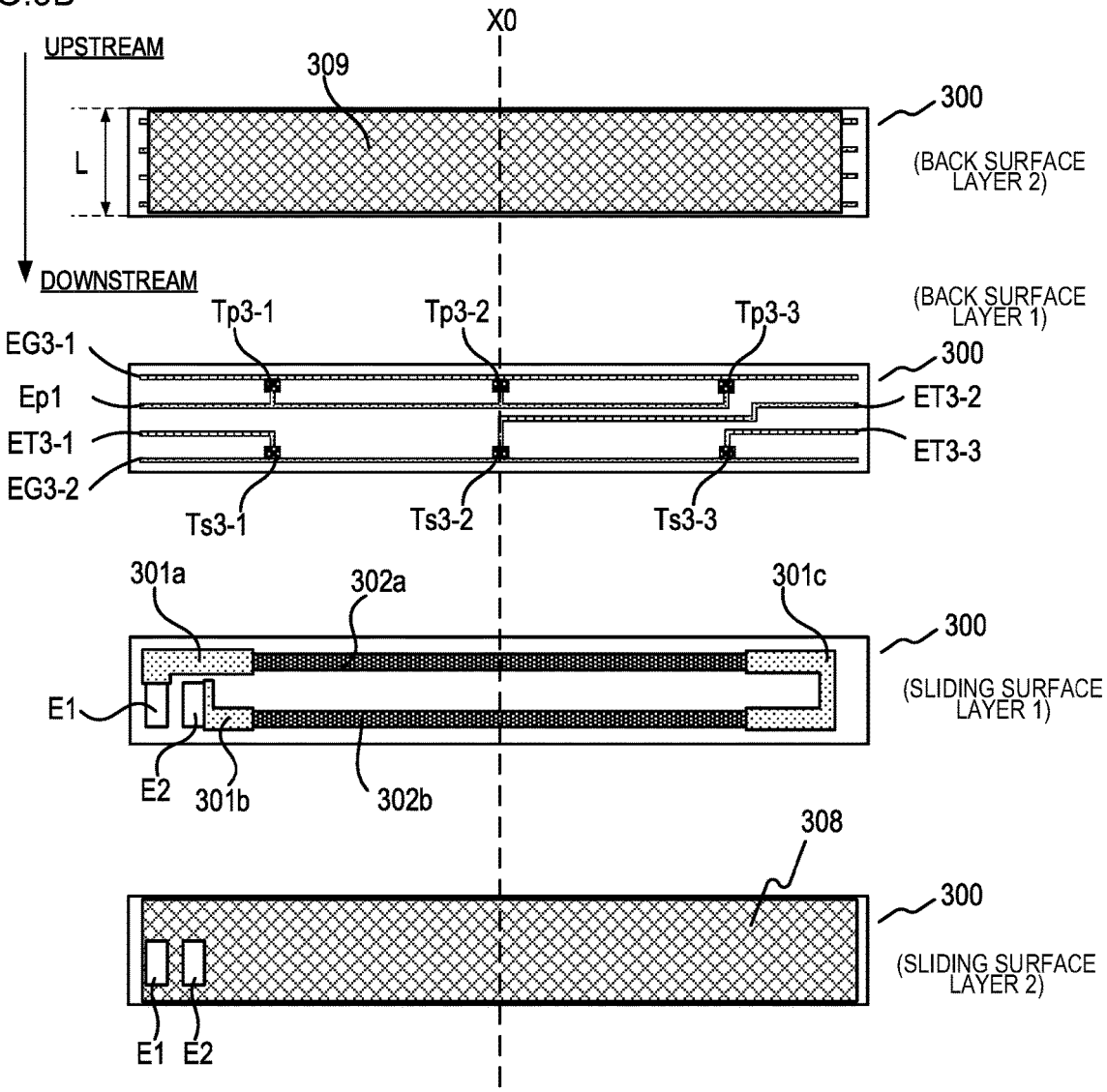

FIG. 3(A) is a sectional pattern diagram showing a lateral direction (an orthogonal direction to the longitudinal direction) of the heater 300, and a sectional view of the vicinity of a transport reference position X0 shown in FIG. 3(B). The heater 300 includes the heating elements 302*a*, 302*b*, which are provided along the longitudinal direction of the heater 300 on the surface of a sliding surface layer 1 serving as a first surface of the substrate 305. The heating element 302*a* is disposed on an upstream side in the transport direction of the recording paper P, and the heating element 302*b* is disposed on a downstream side. The heating elements 302*a*, 302*b* are covered by protective glass 308 serving as a sliding surface layer 2. Further, printed thermistors Ts3-2, Tp3-2 exist on the surface of a back surface layer 1, which is the opposite surface to the sliding surface layers 1 and 2 and serves as a second surface of the substrate 305. The thermistors have a negative resistance temperature characteristic such that variation in the resistance values thereof is dependent upon temperature.

FIG. 3(B) is a planar pattern diagram of the heater 300, further illustrating the respective layers.

The heating elements 302*a*, 302*b*, conductors 301*a*, 301*b*, 301*c* connected thereto, and power supply electrodes E1, E2 are provided on the sliding surface layer 1 of the heater 300. The protective glass 308 constituting the sliding surface layer 2 covers the sliding surface layer 1 from above the sliding surface layer 1 so that only the electrodes E1, E2 are exposed (i.e. so as to exclude an area of the sliding surface layer 1 in which the electrodes E1, E2 are formed). The heating elements 302*a*, 302*b* generate heat when electrified by voltages applied to the electrodes E1, E2. Power is supplied to the electrodes E1, E2 by a contact-type power supply such as a connector or by a method such as welding.

Thermistors Ts3-1 to Ts3-3 serving as first temperature detection elements and thermistors Tp3-1 to Tp3-3 serving as second temperature detection elements are arranged on the back surface layer 1 of the heater 300. The thermistors Ts3-1 to Ts3-3 and the thermistors Tp3-1 to Tp3-3 are arranged at predetermined intervals in the longitudinal direction of the substrate 305 in positions that differ from each other in the lateral direction of the substrate 305, which is orthogonal to the longitudinal direction. The thermistor Tp3-2 and the thermistor Ts3-2 are arranged near the longitudinal direction center of the heating elements 302*a*, 302*b*. Of these thermistors, the thermistor Ts3-2 is used by a CPU 420 in temperature regulation control, to be described below. The thermistors Tp3-1, Tp3-3, Ts3-1, and Ts3-3, meanwhile, are arranged near longitudinal direction end portions of the heating elements 302*a*, 302*b*, and the temperatures thereof are detected by the CPU 420. These thermistors are provided to detect temperature increases occurring in non-paper feeding portions when paper that is shorter than the overall length of the heating elements 302*a*, 302*b* is printed continuously. Further, the thermistor Tp3-1 and the thermistor Ts3-1 are arranged in an approximately identical positional relationship in the longitudinal direction of the heater 300 so that the temperatures indicated by the thermistors are approximately identical. This applies likewise to the relationship between the thermistor Tp3-3 and the thermistor Ts3-3.

Conductors connected to the respective thermistors are also formed on the back surface layer 1. Conductors EG3-1, EG3-2 are connected to one end of the respective thermistors and connected to a ground potential of a thermistor temperature detection portion of a control circuit, to be described below. Conductors ET3-1 to ET3-3 are connected respectively to the thermistors Ts3-1 to Ts3-3 and formed to extend to the longitudinal direction end portions of the heater 300. The conductors are thus connected to the thermistors Ts3-1 to Ts3-3 independently so that each of the thermistors Ts3-1 to Ts3-3 outputs an individual temperature signal, and therefore the thermistors Ts3-1 to Ts3-3 will be referred to hereafter as the independent thermistors Ts3-1 to Ts3-3. Meanwhile, a conductor Ep1 is connected to all of the thermistors Tp3-1 to Tp3-3 so as to form a parallel connection. Accordingly, the thermistors Tp3-1 to Tp3-3 will be referred to hereafter as the parallel thermistors Tp. A width L of the heater 300 tends to increase in accordance with the number of thermistors and the number of conductors, but by forming a parallel connection, the number of conductors can be reduced in comparison with a case where conductors are connected independently. As a result, the thermistors and conductors can be arranged without increasing the width L of the heater 300. A protective glass 309 is formed on a back surface layer 2 except at the longitudinal direction end portions of the heater 300. Some of the conductors not covered by the protective glass 309 serve as connection points to the control circuit 400, to be described below.

Figure 4:
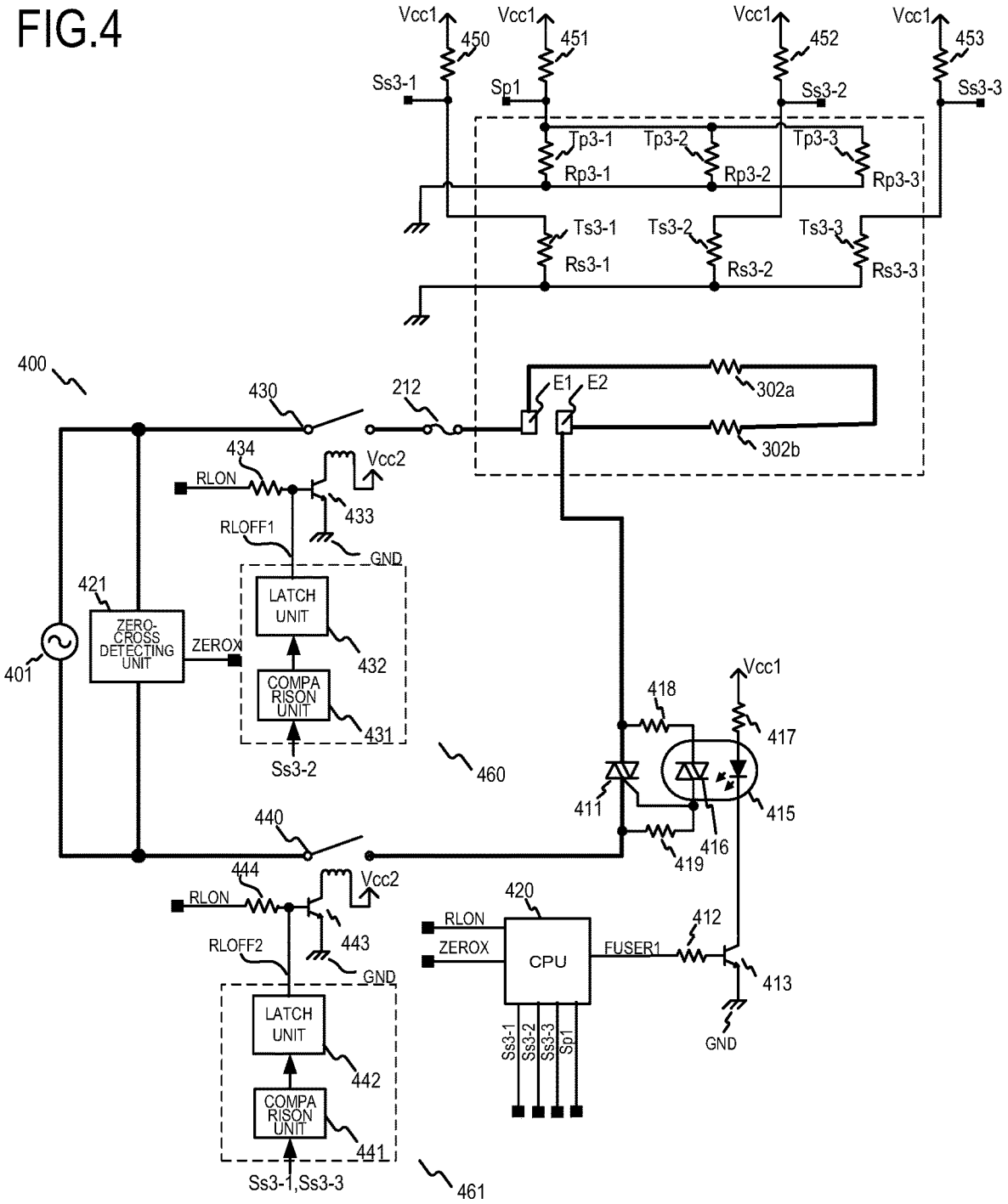
FIG. 4 is a control circuit diagram according to the first embodiment.

FIG. 4 is a circuit diagram showing the control circuit 400 of the heater 300 according to the first embodiment. The commercial AC power supply 401 is connected to the laser printer 100. Power supply voltages Vccl, Vcc2 serve as a DC power supply generated by an AC/DC converter, not shown in the figure, connected to the AC power supply 401. The AC power supply 401 is connected to the electrodes E1, E2 of the heater 300 via relays 430, 440. Power control of the heater 300 is performed by electrifying and disconnecting a triac 411.

A drive circuit configuration of the triac 411 will now be described. Resistors 418, 419 are bias resistors for driving the triac 411, and a phototriac coupler 415 is a device for securing a creepage distance between a primary side and a secondary side. By electrifying a light-emitting diode of the phototriac coupler 415, a triac 416 is switched ON. A resistor 417 is a resistor for limiting a current flowing to the light-emitting diode of the phototriac coupler 415 from the power supply voltage Vccl. A transistor 413 operates in response to a FUSER1 signal transmitted thereto from the CPU 420 via a base resistor 412 so as to switch the phototriac coupler 415 ON/OFF. Note that an ON timing of the FUSER1 signal is generated by the CPU 420 on the basis of a timing signal ZEROX that is generated by a zero-cross detecting unit 421 and synchronized with a zero potential of the AC power supply 401. The relays 430, 440 are used as means for cutting off the power supplied to the heater 300 when the temperature of the heater 300 rises excessively due to a breakdown or the like.

A circuit operation of the relay 430 will now be described. When the CPU 420 sets an RLON signal in a High state, a transistor 433 enters an ON state, whereby a secondary side coil of the relay 430 is electrified by the power supply voltage Vcc2, and as a result, a primary side contact of the relay 430 enters an ON state. When the RLON signal is set in a Low state, the transistor 433 enters an OFF state, whereby a current flowing to a secondary side coil of the relay 430 from the power supply voltage Vcc2 is shut off, and as a result, the primary side contact of the relay 430 enters an OFF state. A similar operation is performed in the relay 440. Note that resistors 434, 444 are resistors for limiting base currents of the transistors 433, 443.

Operations of safety circuits 460, 461 using the relays 430, 440 will now be described. When the temperature detected by the thermistor Ts3-2 exceeds a set predetermined value, a comparison unit 431 activates a latch unit 432, and the latch unit 432 latches an RLOFF1 signal to the Low state. Once the RLOFF1 signal has entered the Low state, the transistor 433 is maintained in the OFF state even when the CPU 420 switches the RLON signal to the High state, and therefore the relay 430 can be maintained in the OFF state (a safe state). Likewise with regard to the thermistors Ts3-1 and Ts3-3, when the temperature of either thereof exceeds a set predetermined value, a comparison unit 441 activates a latch unit 442 so as to latch an RLOFF2 signal to the Low state.

A temperature detection method and control executed by the CPU 420 will now be described. A resistance value of the temperature controlling thermistor Ts3-2 described using FIGS. 3A and 3B is Rs3-2. The voltage is divided between the temperature controlling thermistor Ts3-2 and a resistor 452. Then, the voltage divided thereby is input into the CPU 420 as a signal Ss3-2 serving as a temperature signal converted into a voltage of 0 to Vccl.

[Math. 1]

$$S_{s3-2} = Vcc1 \times \frac{R_{s3-2}}{R_{s3-2} + R_{452}} \quad (1)$$

An A/D converter is provided in an input portion of the CPU 420 so that the input voltage is converted into a digital value. The CPU 420 stores a relationship between this digital value and the temperature in a nonvolatile memory, not shown in the figure, in the form of a digital-value-to-temperature table or a function, and detects the temperature by converting the input signal into a corresponding temperature. The CPU 420 then calculates the power to be supplied by executing PI control, for example, on the basis of the set temperature and the temperature of the thermistor Ts3-2. Further, the CPU 420 converts the calculated power into a control level of a phase angle (phase control) and a wave number (wave number control) corresponding to the power to be supplied and controls the triac 411 in accordance with this control condition.

The CPU 420, which functions simultaneously as an electrification control portion or a power control portion, a temperature acquisition portion, and an operation control portion of the present invention, controls power to be supplied to of the respective heating elements so that the temperature signals output from the thermistors arranged on the substrate remain within a predetermined temperature range. For example, a temperature at or above 230° C., at which hot offset may occur in the toner in relation to the recording material, may be set as an abnormal heat generation state, and the temperature range of the temperature regulation control may be set to have an upper limit below 230° C. and a lower limit of 170° C., at which a fixing defect may occur due to the low temperature. Within this temperature range, 200° C. is set as a target set temperature, and electrification or power control is controlled so as to maintain the temperatures in the heat generating areas at approximately 200° C. Note that specific set temperature values may be set as appropriate in accordance with the apparatus configuration and so on.

The voltage is likewise divided between each of the thermistors Ts3-1, Ts3-3 and a corresponding resistor. Then, signals (signals Ss3-1, Ss3-3) based on the voltages divided thereby are detected by the CPU 420.

[Math. 2]

$$S_{s3-1} = Vcc1 \times \frac{R_{s3-1}}{R_{s3-1} + R_{450}} \tag{2}$$

[Math. 3]

$$S_{s3-3} = Vcc1 \times \frac{R_{s3-3}}{R_{s3-3} + R_{453}} \tag{3}$$

The CPU 420 compares a threshold temperature stored in advance in the nonvolatile memory with the thermistor Ts3-1 and the thermistor Ts3-3, and having determined an abnormality in the image forming apparatus, stops the fixing apparatus 200 and stops a printing operation (an image forming operation).

The CPU 420 detects a signal Sp1 of the parallel thermistors Tp as a single temperature signal obtained by adding the individual temperature signals from the three thermistors Tp3-1 to Tp3-3 together. The voltage of the signal Sp1 is divided between a resistor 451 and a combined parallel resistor (set as Rp) of Rp3-1 to Rp3-3 and input into the CPU 420.

[Math. 4]

$$S_{p1} = Vcc1 \times \frac{R_p}{R_p + R_{451}} \tag{4}$$

The parallel thermistors Tp are provided so that even if one of the independent thermistors Ts3-1 to Ts3-3 breaks down, the temperature thereof can be detected. The signal Sp1 is obtained by connecting the three thermistors in parallel, and therefore the CPU 420 cannot read the temperatures detected by the respective thermistors from the signal Sp1 alone. Hence, the temperatures of the respective thermistors included in the parallel thermistors Tp are detected (the temperature signals of the respective thermistors included in the signal Sp1 are acquired individually) by performing calculation processing in the interior of the CPU 420 in accordance with the detection results acquired by the independent thermistors Ts3-1 to Ts3-3. The calculation method will be described below.

The resistance values Rs3-1 to Rs3-3 of the independent thermistors Ts3-1 to Ts3-3 and the combined parallel resistance Rp of the parallel thermistors can be calculated from formulae (1) to (4) described above, as illustrated in formulae (5) to (8). Note that values of Vcc1 and pullup resistors 450 to 453 are stored in a memory.

[Math. 5]

$$R_{s3-1} = \frac{S_{s3-1} \times R_{450}}{Vcc1 - S_{s3-1}} \tag{5}$$

[Math. 6]

$$R_{s3-2} = \frac{S_{s3-2} \times R_{452}}{Vcc1 - S_{s3-2}} \tag{6}$$

[Math. 7]

$$R_{s3-3} = \frac{S_{s3-3} \times R_{453}}{Vcc1 - S_{s3-3}} \tag{7}$$

[Math. 8]

$$R_{p1} = \frac{S_{p1} \times R_{451}}{Vcc1 - S_{p1}} \tag{8}$$

Incidentally, the combined parallel resistance Rp1 is expressed by a parallel calculation, as shown in formula (9).

[Math. 9]

$$\frac{1}{R_{p1}} = \frac{1}{R_{p3-1}} + \frac{1}{R_{s3-2}} + \frac{1}{R_{s3-3}} \tag{9}$$

Here, a case in which the independent thermistor Ts3-1 breaks down is envisaged. As described using FIGS. 3A and 3B, a combination of the parallel thermistor Tp3-2 and the independent thermistor Ts3-2 and a combination of the parallel thermistor Tp3-3 and the independent thermistor Ts3-3 have identical positional relationships. Hence, assuming that the temperatures thereof are substantially equal, Rs3-2=Rp3-2 and Rs3-3=Rp3-3, and therefore the following formula is obtained.

[Math. 10]

$$\frac{1}{R_{p3-1}} = \frac{1}{R_{p1}} - \frac{1}{R_{s3-2}} - \frac{1}{R_{s3-3}} \quad (10)$$

Rp3-1 can be calculated from formula (10). In other words, even when the independent thermistor Ts3-1 breaks down, the temperature at the end portion of the heater 300 can be detected by calculating the detected temperature of the parallel thermistor Tp3-1. The CPU 420 executes the operation described above, and when the heating elements 302*a*, 302*b* increase in temperature abnormally, for example, the CPU 420 can detect the abnormality and halt electrification or power control of the heater 300 by stopping the RLON signal and the FUSER1 signal. Similar calculations can be implemented in relation to the parallel thermistors Tp3-2, Tp3-3, and therefore, even when the independent thermistors Ts3-2, Ts3-3 break down, an abnormal temperature can be detected and electrification of the heater 300 can be halted. Hence, with a configuration in which a parallel thermistor and an independent thermistor detect identical temperatures, by executing the calculations described above, the temperature of the independent thermistor can be detected even when the independent thermistor breaks down.

Figure 5:
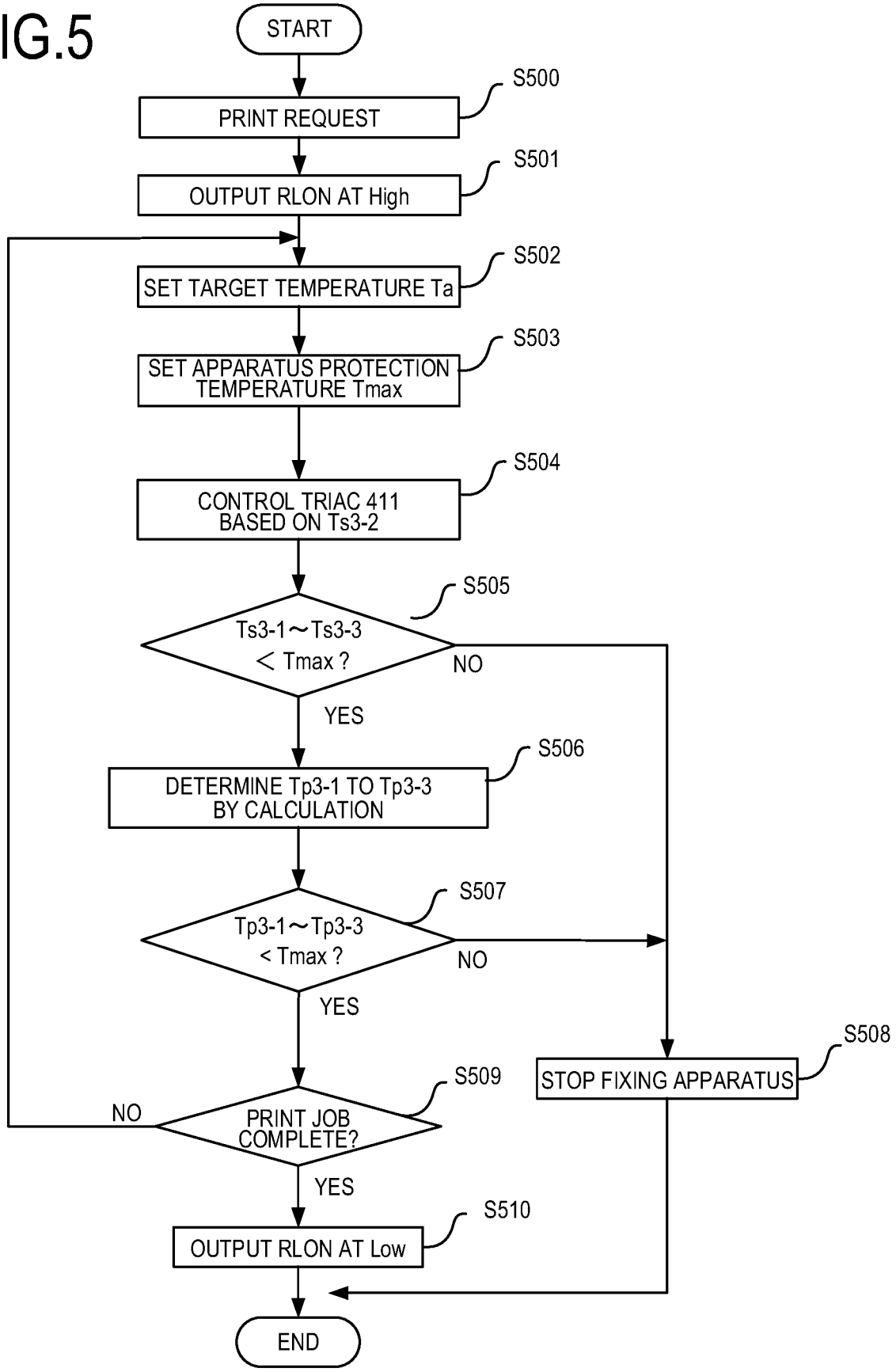
FIG. 5 is a control flowchart according to the first embodiment.

FIG. 5 is a flowchart of the first embodiment. When a print request is received in S500, the routine advances to the following processes. In S501, the RLON signal is output at High, whereby the relays 430, 440 are switched ON. In S502, the CPU 420 reads a target temperature Ta stored in a memory, not shown in the figures, built into the CPU 420 in advance. In S503, an apparatus protection temperature Tmax (230° C., for example) is read from the internal memory. In S504, the temperature of the thermistor Ts3-2 is detected and the triac 411 is controlled. In S505, the temperatures of Ts3-1 to Ts3-3 are detected and compared with Tmax, and when any one of the temperatures equals or exceeds Tmax, electrification or power control is halted (S508). When the temperatures are lower than Tmax, Tp3-1, Tp3-2, and Tp3-3 are calculated using the calculations described above (S506). In S507, the calculated values of Tp3-1 to Tp3-3 are compared with Tmax, and when Tp3-1 to Tp3-3 are at temperatures equaling or exceeding Tmax, electrification or power control is halted (S508). The reason for this is that when the independent thermistor is compared with Tmax in S505, the independent thermistor may have broken down, and in this case, the temperature thereof cannot be detected. Hence, rather than determining the temperature using only the independent thermistor, the fixing apparatus 200 is stopped when both the independent thermistor and one of the parallel thermistors are determined to be abnormal. In S509, the routine is repeated until the print job is complete, and when the print job is complete, RLON is output at the Low level, whereby the relays 430, 440 are switched OFF.

According to this embodiment, as described above, the respective temperatures of the thermistors connected in parallel can be detected using the temperature detection results of the independent thermistors. Hence, an increase in the width of the heater can be suppressed by connecting some of the plurality of thermistors in parallel, and an abnormal temperature in the heater can be detected by the parallel thermistors. As a result, the safety of the fixing apparatus can be protected.

Note that in this embodiment, thermistors having a negative resistance temperature characteristic were used, but the present invention is not limited thereto. Further, the pattern of the heating elements on the sliding surface layer 1 is not limited to the pattern of this embodiment, and instead, for example, a pattern in which the heat generation amount is varied between the central portion and the end portions of the heater or the like may be used. Furthermore, the number of thermistors connected in parallel is not limited to three, and as long as at least two thermistors are connected in parallel, similar effects are obtained. Moreover, in this embodiment, a configuration in which the thermistors are provided on the surface of the substrate on the opposite side to the surface on which the heating elements are provided was used, but the thermistors may be provided on the same surface as the heating elements.

Furthermore, in this embodiment, the determination as to whether or not a predetermined temperature has been exceeded in the parallel thermistors is executed on all of the thermistors that perform temperature detection in the paper feeding area (S507 in FIG. 5), but the determination may be executed only on the thermistors on the end portions of the paper feeding area.

Second Embodiment

Next, a second embodiment relating to a heater 600 in which, in contrast to the heater 300 described in the first embodiment, the heat generating areas are divided in the longitudinal direction will be described, the second embodiment serving as a modified example of the heating element pattern. Identical reference symbols have been used for similar configurations to the first embodiment, and description thereof has been omitted.

Figure 6A:
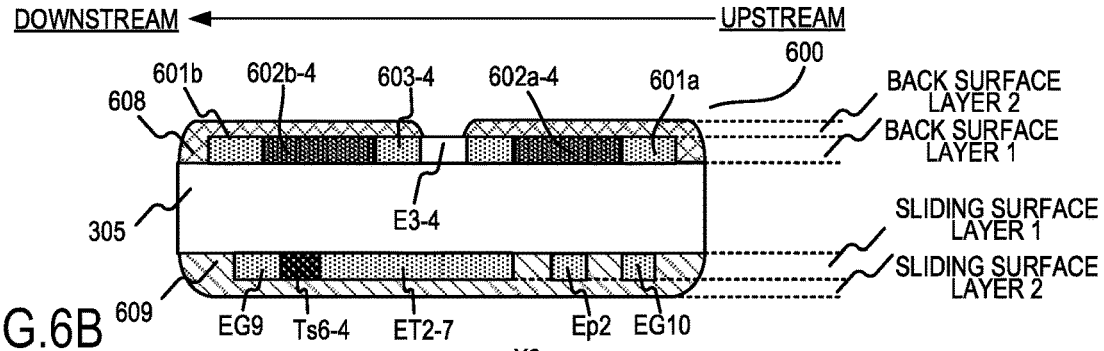
FIGS. 6A and 6B are views showing a heater configuration according to a second embodiment.
Figure 6B:
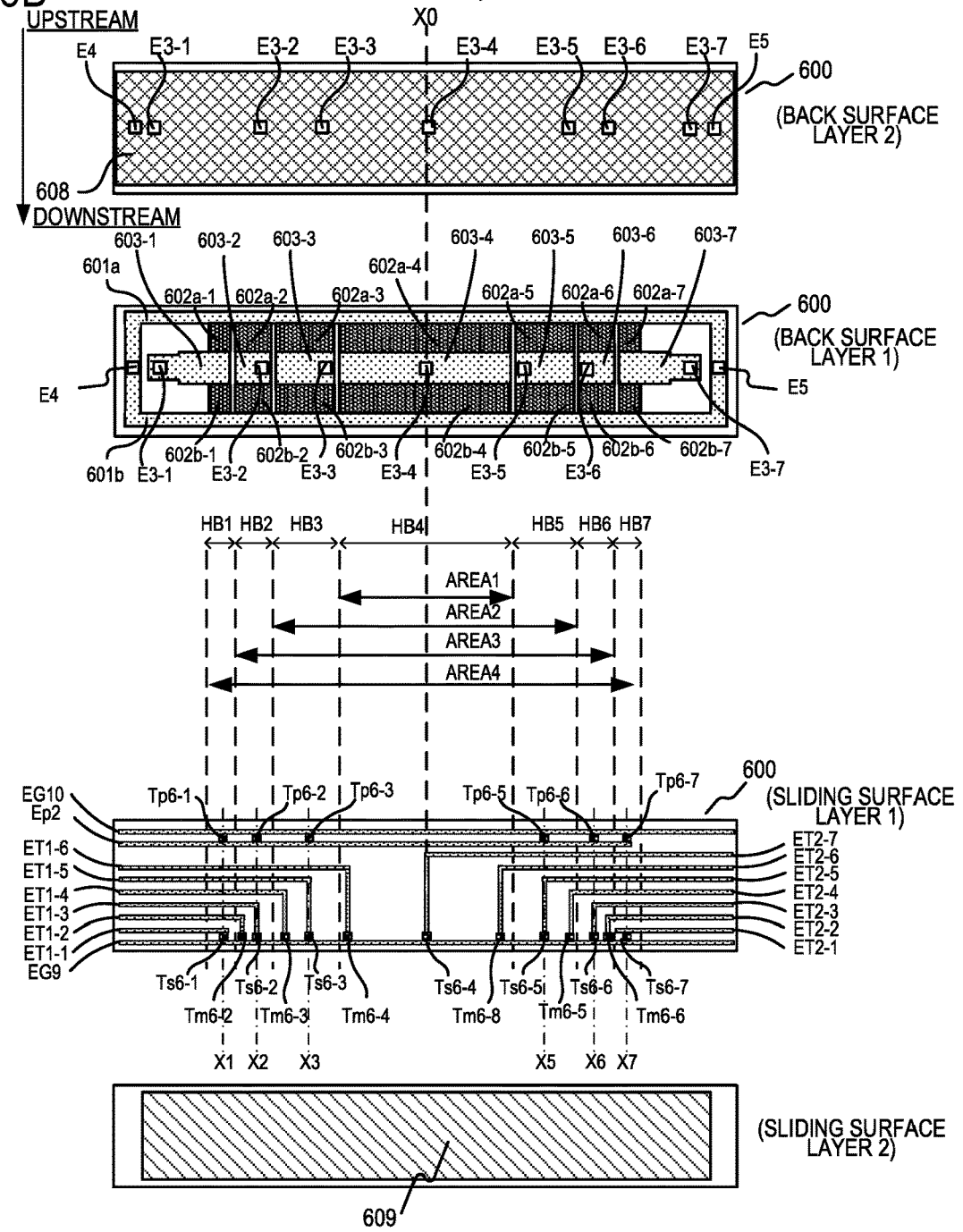

FIGS. 6A and 6B show a sectional view and a planar view of the heater 600. The sectional view in FIG. 6(A) is similar to the first embodiment. On the back surface layer 1 of the heater 600, a conductor 601 and a conductor 603 are provided on the substrate 305. The conductor 601 is divided into a conductor 601*a* disposed on the upstream side of the transport direction of the recording material P, and a conductor 601*b* disposed on the downstream side. The conductor 603 is divided into conductors 603-1 to 603-7 in the longitudinal direction of the substrate 305. The heater 600 further includes a heating element 602 that generates heat in response to power supplied thereto via the conductor 601 and the conductor 603, the heating element 602 being provided between the conductor 601 and the conductor 603. The heating element 602 is divided into a heating element 602*a* disposed on the upstream side of the transport direction of the recording material P, and a heating element 602*b* disposed on the downstream side. In addition, the heating element 602*a* and the heating element 602*b* are divided into heating elements 602*a*-1 to 602*a*-7 and 602*b*-1 to 602*b*-7, respectively. More specifically, a heating element 602*a*-4 serving as a first heating element is disposed in the center of the transport area of the recording material, and heating elements 602*a*-1 to 602*a*-3, 602*a*-5 to 602*a*-7 serving as second heating elements are disposed on respective sides thereof in order to enlarge the heat generating area in the longitudinal direction. The heating elements 602*b*-1 to 602*b*-7 are arranged similarly. Electrodes E3-1 to E3-7, E4, and E5 used to supply power are also provided. Furthermore, on a back surface layer 2, insulating protective glass 608 covers an area of the back surface layer 1 excluding the electrodes E3-1 to E3-7, E4, and E5.

FIG. 6(B) is a planar view of the heater 600, illustrating the respective layers.

Seven heat generating blocks, each constituted by a group of the conductor 601, the conductor 603, the heating element 602, and the electrode E3, are provided on the back surface layer 1 of the heater 600 in the longitudinal direction of the heater 600 (HB1 to HB7). To indicate associations with the seven heat generating blocks HB1 to HB7, numerals have been added to the ends of components, as illustrated by the heating elements 602*a*-1 to 602*a*-7. This applies likewise to the heating element 602*b*, the conductors 601*a* and 601*b*, the conductor 603, and the electrode E3.

Figure 8:
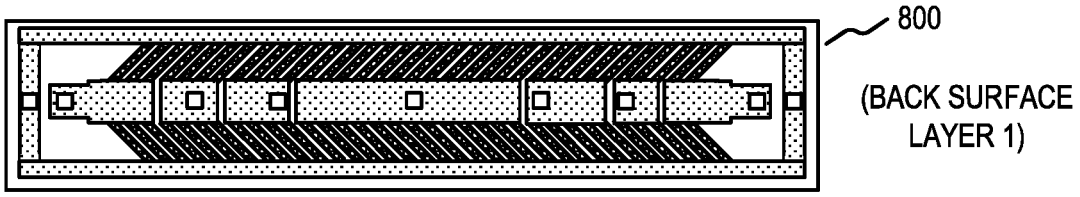
FIG. 8 shows a modified example of the heater configuration according to the second embodiment.

Further, the surface protecting layer 608 on the back surface layer 2 of the heater 600 is formed so as to exclude the locations of the electrodes E3-1 to E3-7, E4, and E5 so that electrical contacts, not shown in the figures, can be connected from the back surface side of the heater 600. Power can be supplied independently to each heat generating block, and power supply control can be executed independently. By forming the seven divided heat generating blocks in this manner, four paper feeding areas, indicated as AREA1 to AREA4, can be formed. In this embodiment, the paper feeding areas are classified such that AREA1 is for A5 paper, AREA2 is for B5 paper, AREA3 is for A4 paper, and AREA4 is for letter paper. Since the seven heat generating blocks can be controlled independently, the heat generating blocks to which power is to be supplied are selected in accordance with the size of the recording paper P. Note that the number of heat generating areas and the number of heat generating blocks are not limited to the numbers cited in this embodiment. Further, the heating elements 602*a*-1 to 602*a*-7 and 602*b*-1 to 602*b*-7 provided in the respective heat generating blocks are not limited to a continuous pattern, as described in this embodiment, and may be arranged in a strip-like pattern having gap portions, as shown in FIG. 8, for example.

A group of thermistors for detecting the temperature in each heat generating block of the heater 600 is disposed on the sliding surface layer 1 of the heater 600. Thermistors Ts6-1 to Ts6-7 are thermistors (referred to hereafter as temperature controlling thermistors) mainly used to perform temperature regulation control on the respective heat generating blocks, and these thermistors are independent thermistors disposed near the centers of the respective heat generating blocks. Thermistors Tm6-2 to Tm6-8 are thermistors (referred to hereafter as end portion thermistors) for detecting the temperature in the non-paper feeding areas (the end portions) when recording paper having a narrower width than the heat generating areas is fed, and these thermistors are also independent thermistors. The thermistors Tm6-2 to Tm6-8 are arranged near the outer sides of the respective heat generating blocks relative to a transport reference position X0. Note that in HB1 and HB7, the heat generating areas are narrow, and therefore end portion thermistors are not required. Accordingly, end portion thermistors are not disposed therein. Next, thermistors Tp6-1 to Tp6-3 and Tp6-5 to Tp6-7 are prepared so that even when the temperature controlling thermistors or the end portion thermistors break down, the temperatures thereof can be detected, and these thermistors are connected in parallel. Furthermore, the thermistors Tp6-1 to Tp6-3 and Tp6-5 to Tp6-7 are arranged in a substantially equal positional relationship to longitudinal direction positions X1 to X3 and X5 to X7 of the temperature controlling thermistors Ts6-1 to Ts6-7. Accordingly, the parallel thermistors Tp6-1 to Tp6-3 and Tp6-5 to Tp6-7 detect approximately identical temperatures to the temperature controlling thermistors Ts6-1 to Ts6-3 and Ts6-5 to Ts6-7 corresponding respectively to the positions thereof. Note that in this embodiment, the positional relationships of the temperature controlling thermistors and the parallel thermistors are aligned, but the present invention is not limited thereto, and the positional relationship may be aligned with the end portion thermistors. Furthermore, in contrast to the first embodiment, there is no need to prepare parallel thermistors corresponding to all of the independent thermistors, and a relationship of number of parallel thermistors<number of independent thermistors, as in this embodiment, may be provided.

The independent thermistors are respectively connected to conductors ET1-1 to ET1-6 and conductors ET2-1 to ET1-7 at one end and to a conductor EG9 at the other end. The parallel thermistors Tp6-1 to Tp6-3 and Tp6-5 to Tp6-7 are connected in common to a conductor Ep2 at one end and connected in common to a conductor EG10 at the other end. A surface protective layer 609 constituted by a glass coating having a sliding property is provided on the sliding surface layer 2 of the heater 600. In order to provide electrical contacts on the respective conductors on the sliding surface layer 1, the surface protective layer 609 is provided so as to exclude the respective end portions of the heater 600.

Figure 7:
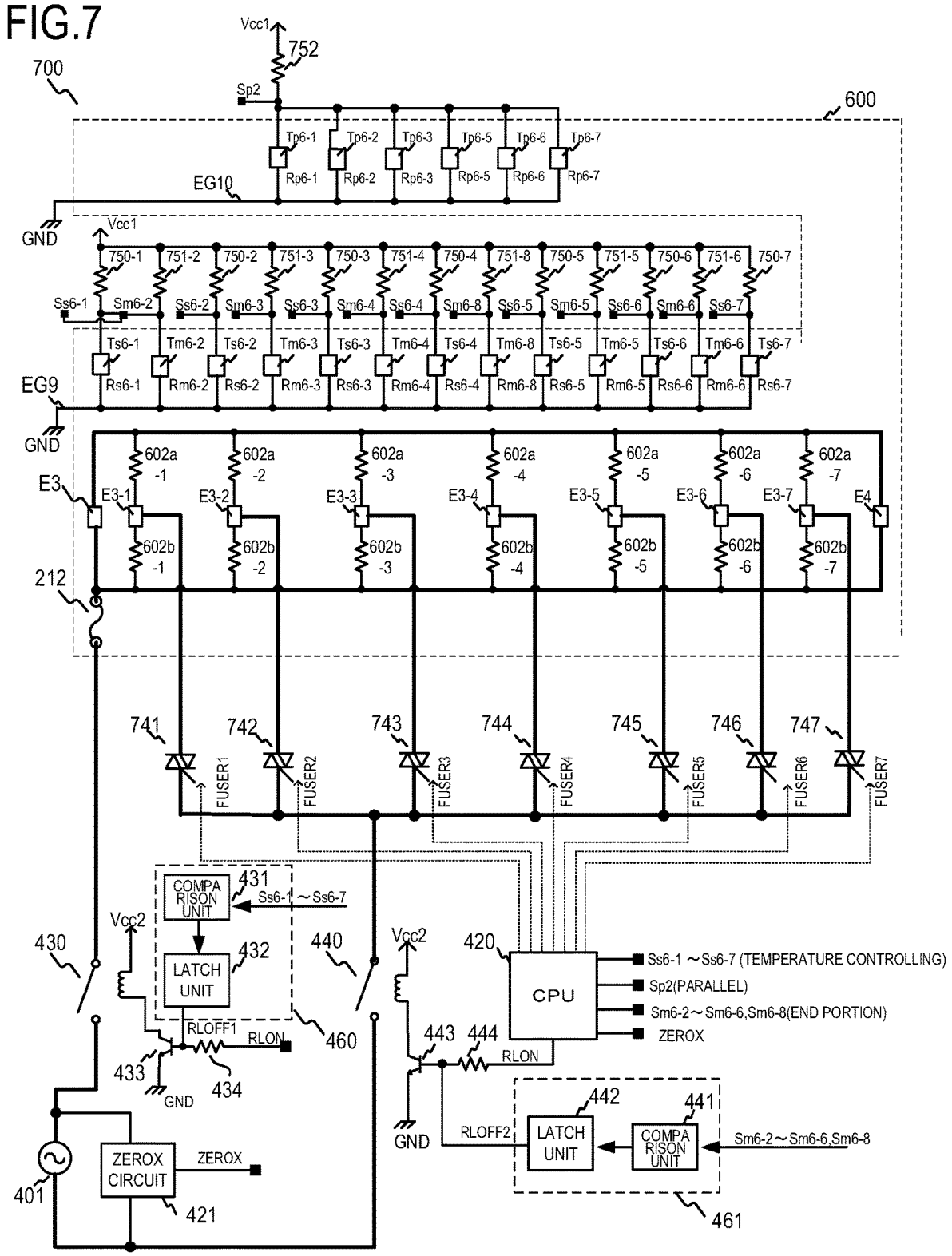
FIG. 7 is a control circuit diagram according to the second embodiment.

FIG. 7 shows a control circuit 700 of the heater 600 according to the second embodiment. In this embodiment, triacs 741 to 747 are disposed in accordance with the number of heat generating blocks. The CPU 420 outputs signals FUSER1 to FUSER7 for driving the respective triacs. Note that the triac drive circuit is identical to that of the first embodiment and is therefore not shown in the figure. The triacs are respectively connected to the electrodes E3-1 to E3-7, and power is controlled by switching electrification or power control of the heating elements 602*a*-1 to 602*a*-7 and 602*b*-1 to 602*b*-7 ON and OFF.

Next, a temperature detection method and control executed by the CPU 420 will be described. The voltage is divided between each of the thermistors and a corresponding pullup resistor among 750-1 to 750-7, 751-2 to 751-8, and 752. Then, the voltages divided thereby are input into the CPU 420. Here, when the resistance values of Ts6-t (t=1 to 7) and Tm6-t (t=2 to 6 and 8) are set as Rs6-t (t=1 to 7) and Rm6-t (t=2 to 6 and 8) and the signals are set as Ss6-t (t=1 to 7) and Sm6-t (t=2 to 6 and 8), the following formulae are obtained.

[Math. 11]

$$\text{Temperature controlling (independent) thermistors: } S_{s6-t} = Vcc1 \times \frac{R_{s6-t}}{R_{s6-t} + R_{750-t}} (t = 1 \sim 7) \tag{11}$$

[Math. 12]

$$\text{End portion (independent) thermistors: } S_{m6-t} = Vcc1 \times \frac{R_{m6-t}}{R_{m6-t} + R_{753-t}} (t = 2 \sim 6, 8) \tag{12}$$

[Math. 13]

$$\text{Parallel thermistors: } S_{p2} = Vcc1 \times \frac{R_{p2}}{R_{p2} + R_{752}} \tag{13}$$

Similarly to the first embodiment, the CPU 420 cannot read the detected temperatures of the respective thermistors from a signal Sp2 alone. Therefore, the temperatures of the respective thermistors are detected (temperature signals from the respective thermistors are acquired individually) by performing calculation processing in the interior of the CPU 420 in accordance with the detection results acquired by the independent thermistors Ts6-1 to Ts6-7. The calculation method will be described below.

Formulae (14) to (16) can be calculated from formulae (11) to (13), illustrated above. Note that values of Vccl and pullup resistors R750, 751, 752 are stored in a memory.

[Math. 14]

$$R_{s6-t} = \frac{S_{s6-t} \times R_{750-t}}{Vcc1 - S_{s6-1}} (t = 1 \sim 7) \tag{14}$$

[Math. 15]

$$R_{m6-t} = \frac{S_{m6-t} \times R_{751-t}}{Vcc1 - S_{m6-t}} (t = 2 \sim 6, 8) \tag{15}$$

[Math. 16]

$$R_{p2} = \frac{S_{p2} \times R_{752}}{Vcc1 - S_{p2}} \tag{16}$$

Incidentally, a combined parallel resistance Rp2 is expressed by a parallel calculation, as shown in formula (17).

[Math. 17]

$$\frac{1}{R_{p2}} = \frac{1}{R_{s6-1}} + \frac{1}{R_{s6-2}} + \frac{1}{R_{s6-3}} + \frac{1}{R_{s6-5}} + \frac{1}{R_{s6-6}} + \frac{1}{R_{s6-7}} \tag{17}$$

Here, a case in which the thermistor Ts6-1 breaks down is envisaged. The parallel thermistors and the temperature controlling thermistors have substantially identical positional relationships, and therefore, assuming that the temperatures thereof are substantially equal, the following formula is obtained.

[Math. 18]

$$\frac{1}{R_{p6-1}} = \frac{1}{R_{p2}} - \frac{1}{R_{s6-2}} + \frac{1}{R_{s6-3}} + \frac{1}{R_{s6-5}} + \frac{1}{R_{s6-6}} + \frac{1}{R_{s6-7}} \tag{18}$$

Rp6-1 can be calculated from formula (18).

In other words, even when the independent thermistor Ts6-1 breaks down, the temperature of the heat generating block HB1 of the heater 600 can be detected by calculating the detected temperature of Tp6-1. When the heat generating block HB1 increases in temperature abnormally, for example, the CPU 420 can detect the abnormality and halt electrification of the heat generating block HB1 by stopping the RLON signal and the FUSER1 signal. Similar calculations can be implemented in relation to the other individual thermistors Tp6-2, Tp6-3, and Tp6-5 to Tp6-7 included in the parallel thermistors, and therefore, even when a temperature controlling thermistor breaks down, the abnormality can be detected and electrification of the heater 600 can be halted.

Note that the CPU 420 compares the individual thermistors Tp6-1 to Tp6-3 and Tp6-5 to Tp6-7 included in the parallel thermistors with the independent thermistors Ts6-1 to Ts6-3 and Ts6-5 to Ts6-7 corresponding respectively thereto. When, as a result of the comparison, a predetermined temperature difference is found, this may indicate a breakdown in one of the thermistors, and therefore the operations of the fixing apparatus 200 and the laser printer 100 may be stopped on the assumption that the fixing apparatus 200 has broken down.

Hence, likewise in a heater in which the heating elements are divided in the longitudinal direction of the heater, the individual thermistor temperatures of the parallel thermistors can be detected by calculation using the detection results acquired by the independent thermistors.

Figure 9:
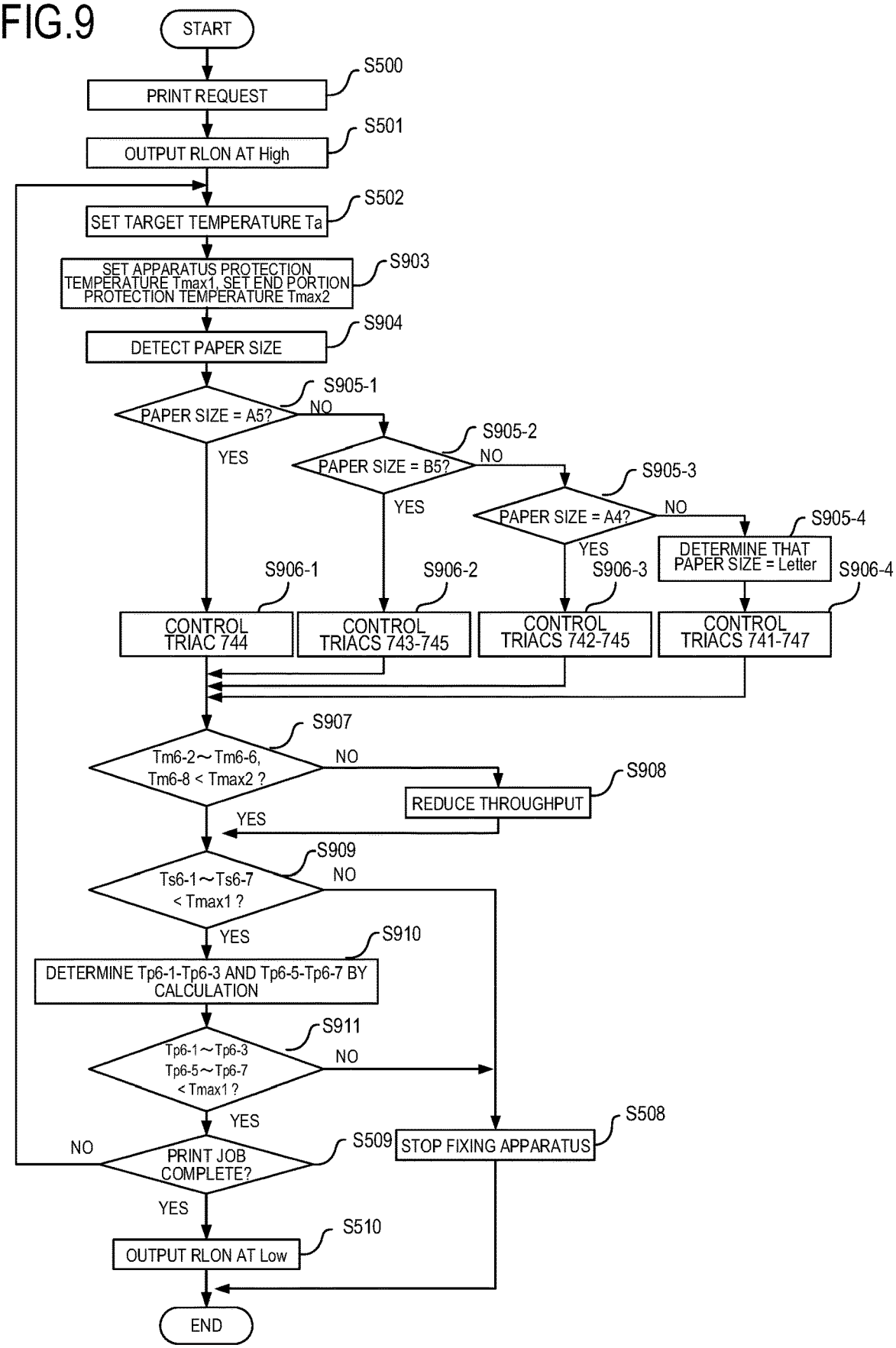
FIG. 9 is a control flowchart according to the second embodiment.

FIG. 9 is a flowchart of the second embodiment. S500 to S502 are similar to the first embodiment and have therefore been omitted. In S903, an apparatus protection temperature Tmaxl for performing protection when the fixing apparatus is abnormal and an end portion protection temperature Tmax2, which is a temperature for preventing components in the interior of the fixing apparatus from being affected by temperature increases at the end portions, are read from the memory, not shown in the figures. In S904, the size of the recording paper P placed on the paper feeding cassette 11 is detected by a paper size detection sensor 22 (FIG. 1) provided in the paper feeding cassette 11. In S905-1 to S905-4, the paper size is determined, and in S906-1 to S906-4, the heat generating areas corresponding to the respective paper sizes are determined and the triacs corresponding to the heat generating areas are controlled. In S907, the temperature of each of the end portion thermistors Tm6-2 to Tm6-6 and Tm6-8 is detected, and when the temperature equals or exceeds the end portion protection temperature Tmax2, control for reducing the throughput is implemented in S908. More specifically, control such as widening the transport interval between recording materials or reducing the transport speed of the recording material may be cited as control for reducing the throughput. In S909, the independent thermistors Ts6-1 to Ts6-7 are compared with the apparatus protection temperature Tmaxl, and when a temperature equals or exceeds Tmaxl, the fixing apparatus 200 is stopped in S508. Even when none of the temperatures exceeds Tmaxl, the temperatures of the parallel thermistors Tp6-1 to Tp6-3 and Tp6-5 to Tp6-7 are calculated in S910, and when one of the temperatures equals or exceeds Tmaxl, the apparatus is stopped (S911, S508). In S509 onward, identical operations to the first embodiment are performed, whereupon the routine is terminated.

As described above, likewise in a heater divided into heat generating blocks, as in this embodiment, the respective temperatures of the thermistors connected in parallel can be detected using the temperature detection results of the independent thermistors. Hence, an increase in the width of the heater can be suppressed by forming a parallel connection, and an abnormal temperature in the heater can be detected, with the result that the safety of the fixing apparatus can be protected. In this type of heater in particular, the number of required thermistors increases as the number of heat generating blocks increases, leading to an increase in the effect of suppressing an increase in the width of the heater by means of the parallel thermistors. Note that even when the number of thermistors included in the parallel thermistors is smaller than the number of independent thermistors, as in this embodiment, equivalent effects are obtained.

The invention claimed is:

1. An image forming apparatus comprising:

a fixing portion that includes a heater having a substrate, a heating element provided on the substrate, and a plurality of temperature detection elements provided on the substrate, and that heats an image formed on a recording material so as to fix the image on the recording material using heat from the heater; and a power control portion that controls power to be supplied to the heating element on the basis of temperature signals output by the temperature detection elements, wherein the plurality of temperature detection elements include:

a plurality of first temperature detection elements that are arranged at predetermined intervals in a longitudinal direction of the substrate and respectively output temperature signals individually; and a plurality of second temperature detection elements that are arranged at predetermined intervals in positions that differ from the positions of the first temperature detection elements in a lateral direction that is orthogonal to the longitudinal direction but correspond to the positions of at least some of the plurality of first temperature detection elements in the longitudinal direction, and that output a single temperature signal obtained by adding individual temperature signals together, and the apparatus further comprises a temperature acquisition portion that acquires the individual temperature signals included in the single temperature signal on the basis of the plurality of temperature signals output by the plurality of first temperature detection elements and the single temperature signal.

2. The image forming apparatus according to claim 1, wherein the power control portion controls power to be supplied to the heating element so that temperatures acquired from the temperature signals output by the first temperature detection elements remain within a predetermined temperature range.

3. The image forming apparatus according to claim 2, wherein the apparatus further comprises an operation control portion that controls an operation of the apparatus, and the operation control portion stops a printing operation when a temperature acquired from the temperature signals output by the first temperature detection elements exceeds a predetermined temperature.

4. The image forming apparatus according to claim 3, wherein, even when the temperatures acquired from the temperature signals output by the first temperature detection elements do not exceed the predetermined temperature, the operation control portion stops the printing operation when a temperature acquired from at least one of the individual temperature signals acquired by the temperature acquisition portion exceeds the predetermined temperature.

5. The image forming apparatus according to claim 4, wherein the heating element includes:

a first heating element disposed in the center of the substrate in the longitudinal direction; and a second heating element disposed on the substrate on each side of the first heating element in the longitudinal direction, and the operation control portion determines whether or not to stop the printing operation at least on the basis of whether or not a temperature acquired from the temperature signals of the second temperature detection elements disposed in positions corresponding to the second heating elements in the longitudinal direction, among the plurality of second temperature detection elements, exceeds the predetermined temperature.

6. The image forming apparatus according to claim 3, wherein, when a temperature acquired from a temperature signal output by a first temperature detection element disposed in a position that does not correspond to a second temperature detection element in the longitudinal direction, among the plurality of first temperature detection elements, exceeds the predetermined temperature, the operation control unit either widens a transport interval between recording materials or reduces a transport speed of the recording material.

7. The image forming apparatus according to claim 1, wherein the plurality of second temperature detection elements are connected to each other in parallel on a circuit that outputs the temperature signals.

8. The image forming apparatus according to claim 1, wherein the first temperature detection elements and the second temperature detection elements are provided on a surface of the substrate on an opposite side to a surface on which the heating element is provided.

9. The image forming apparatus according to claim 1, wherein the fixing portion further comprises a tubular film, and the heater is in contact with an inner surface of the film.

* * * * *